US005493751A

United States Patent [19]

Misiukowiec et al.

[11] Patent Number: 5,493,751

[45] Date of Patent: Feb. 27, 1996

[54] VERSATILE PAINT PAN

[76] Inventors: Daniel Misiukowiec; Juan R. Lo Porto, both of 303 E. 33rd St., Baltimore, Md. 21228

[21] Appl. No.: 334,220

[22] Filed: Nov. 4, 1994

[51] Int. Cl.[6] ..... B44D 3/12

[52] U.S. Cl. ..... 15/257.06; 15/257.05; 220/697; 248/210; 248/911; D32/53.1

[58] Field of Search ..... 15/257.05, 257.06; 182/129; 206/209, 229, 361; 220/23.4, 697, 756; 248/210, 211, 238, 911; D32/53.1

[56] References Cited

U.S. PATENT DOCUMENTS

| | | | |
|---|---|---|---|
| 2,694,825 | 11/1954 | Touchett et al. | 15/257.06 |
| 2,759,620 | 8/1956 | Pharris | 15/257.06 |
| 2,908,468 | 10/1959 | Thomas . | |
| 3,139,188 | 6/1964 | Goetz et al. | 15/257.06 |
| 3,332,653 | 7/1967 | Hoelzel | 248/210 |
| 3,351,970 | 11/1967 | Engh | 15/257.06 |
| 3,707,242 | 12/1972 | Golden et al. . | |
| 3,731,840 | 5/1973 | Beutler et al. | 15/257.06 |
| 3,822,846 | 7/1974 | Jesionowski | 15/257.06 |
| 3,837,034 | 9/1974 | Leffert et al. | 248/210 |
| 3,940,824 | 3/1976 | Gioia et al. | 15/257.06 |
| 4,094,431 | 6/1978 | Wheeler | 15/257.06 |
| 4,205,411 | 6/1980 | Cupp et al. | 15/257.06 |
| 4,787,586 | 11/1988 | Crain | 248/210 |
| 4,979,710 | 12/1990 | Baldwin | 248/210 |
| 5,079,795 | 1/1992 | Schmid | 15/257.06 |
| 5,316,137 | 5/1994 | Kyllonen | 15/257.06 |

FOREIGN PATENT DOCUMENTS

| | | | |
|---|---|---|---|
| 805475 | 12/1958 | United Kingdom | 15/257.06 |

*Primary Examiner*—Mark Spisich
*Attorney, Agent, or Firm*—Leonard Bloom

[57] ABSTRACT

A versatile paint pan has a receptacle and a bracket removably attached to the back of the receptacle. The bracket has a base and two legs. The bracket may be pivoted to dispose the paint pan on a horizontal surface. The bracket may be supported transversely on a step of a ladder such that the receptacle is suspended vertically externally of the side rail of the ladder. The bracket may also be supported substantially parallel to a step of the ladder and such that the receptacle is suspended vertically between the side rails of the ladder. The paint pan has a paint brush holder and a removable cover.

17 Claims, 8 Drawing Sheets

VERSATILE PAINT PAN

FIELD OF THE INVENTION

The present invention relates to a paint pan and, more particularly, to a versatile paint pan which may be disposed on a horizontal surface and also may be suspended from the steps of a ladder.

BACKGROUND ART

Paint pans have been used for many years by professional painters and by individuals such as homeowners. The use of these pans has been greatly increased by the introduction of the paint roller. Because of the widespread use of the paint pans, a variety of designs have been proposed. The applicant is aware of the following:

| Inventor(s) | U.S. Pat. No. |
|---|---|
| Thomas | 2,908,468 |
| Hoelzel | 3,332,653 |
| Golden et al | 3,707,242 |
| Cupp et al | 4,205,411 |
| Crain | 4,787,586 |
| Baldwin | 4,797,710 |

Also, the applicant is aware of a plastic pan having removable plastic legs to support one end of the pan. This product is available in Argentina.

In addition, the applicant is aware of U.S. Pat. No. 3,332,653 issued to Hoelzel which discloses a holder for paint buckets to be mounted on a ladder. Another container support for a paint can is disclosed by Crain in U.S. Pat. No. 4,787,586.

However, the devices disclosed in these patents are primarily for use of the tray on a horizontal position. Only Thomas and Golden et al disclose use of the paint pan in a vertical position. These devices are comparatively complex and expensive. There is a need for a versatile paint pan which can be used in a horizontal or vertical position, can be attached to a ladder without interfering with the use of the ladder and can be produced simply and inexpensively.

SUMMARY OF THE INVENTION

It is a primary object of the invention to provide a versatile paint pan which can be used in either a horizontal or vertical position and which may be removably attached to a ladder.

It is another object of the present invention to provide a paint pan which may be produced inexpensively.

In accordance with the teachings of the present invention, there is disclosed a paint pan for use on a horizontal surface and for suspension alternately from a side and from a face of a ladder. The ladder has a pair of side rails and a plurality of steps between the side rails. The paint pan includes a receptacle having a front wall, a back wall, a first side wall, an opposite second side wall, a bottom and an open top. The back wall is longer than the front wall. The back wall has an upper end. The improvement includes a bracket removably connected to the upper end of the back wall. The bracket has a base, a first leg and an opposite second leg. The legs are substantially perpendicular to the base. The first leg is removably connected to the upper end of the back wall of the receptacle. The second leg has a plurality of notches formed therein, the notches being steplike having a center notch proximal to the base of the bracket and a pair of intermediate notches stepwise adjacent to, and on either side of, the center notch. The intermediate notches are distal from the base of the bracket in relation to the center notch. The paint pan may be disposed on the horizontal surface, the bracket supporting and elevating the upper end of the back wall of the receptacle and the receptacle being oriented at an acute angle with respect to the horizontal surface such that a paint roller and a paint brush may be used. The bracket is further adapted for support on a selected one of the steps of the ladder, transversely thereof, wherein the bracket is secured on the selected one of the steps of the ladder and the receptacle is suspended vertically adjacent to one of the side rails of the ladder, external of the ladder, the side rail of the ladder being embraced by the bracket and the receptacle. In this manner, the paint roller and the paint brush may be used. The attachment means is further adapted for support on the selected one of the steps of the ladder substantially parallel thereto, wherein the bracket is secured on the selected one of the steps of the ladder and the receptacle is suspended vertically therefrom between the side rails along the face of the ladder. In this manner, the paint roller and the paint brush may be used.

These and other objects of the present invention will become apparent from a reading of the following specification, taken in conjunction with the enclosed drawings.

DESCRIPTION OF THE PREFERRED EMBODIMENTS

Figure 1:
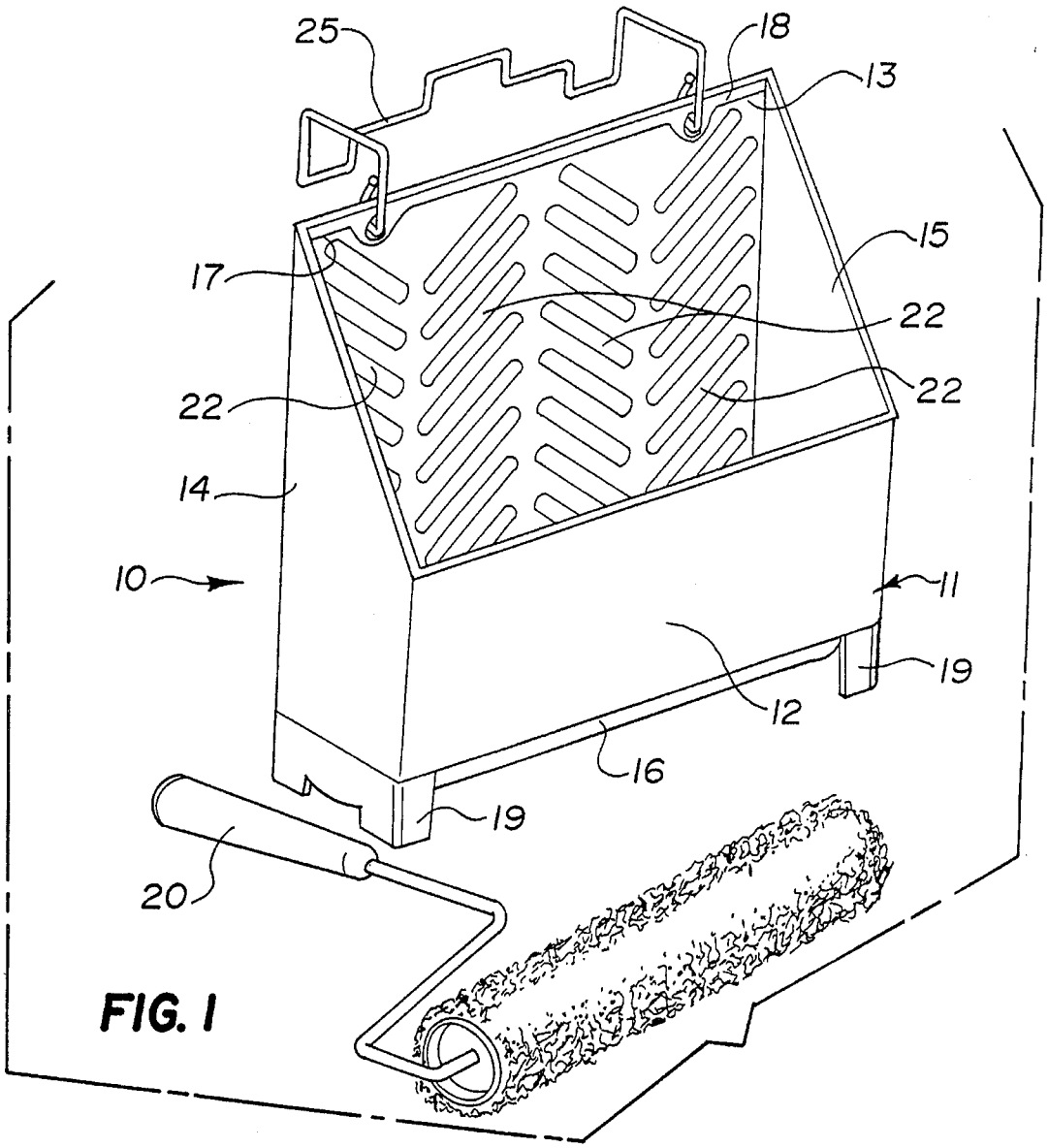
FIG. 1 is a pictorial view of the present invention standing upright and being used with a roller paint applicator.

Referring now to FIG. 1, the paint pan 10 has a receptacle 11 which is formed with a front wall 12, a back wall 13, a first side wall 14, an opposite second side wall 15, a bottom 16 and an open top. The back wall 13 is longer than the front wall 12. The side walls 14, 15 have an upper edge which is angled from the back wall 13 downwardly toward the front wall 12. The back wall has an upper end 17 and a lip 18 is formed on the upper end 17. The lip 18 is oriented toward the front wall 12 and prevents the paint from spilling from the receptacle 11 when the paint pan 10 is disposed on a horizontal surface as will be described. The walls 12, 13, 14, 15 may be angularly connected to the bottom 16 so that the opening at the top is larger in area than the bottom of the receptacle 11. Thus, empty receptacles 11 may be nested or stacked within one another. The bottom 16 of the receptacle 11 has support means 19 such as legs, braces or flat external surfaces formed thereon to support the paint pan 10 in an upright position if desired. When so supported, the paint pan 10 retains the paint within the receptacle 11 and a paint roller 20 or paint brush 21 can be used. Preferably, the bottom 16 of the receptacle 11 is arcuate internally to more readily permit complete removal of paint from within the receptacle 11 with the roller 20 or brush 21 and to prevent accumulation of paint in corners. Also, the back wall 13 has a plurality of spaced apart raised members 22 formed thereon to assist in the removal of excess paint from the paint roller 20. The raised members may be ribs, knobs or have any desired shape effective for removal of the excess paint as the roller is rolled over the raised members 22.

Figure 2:
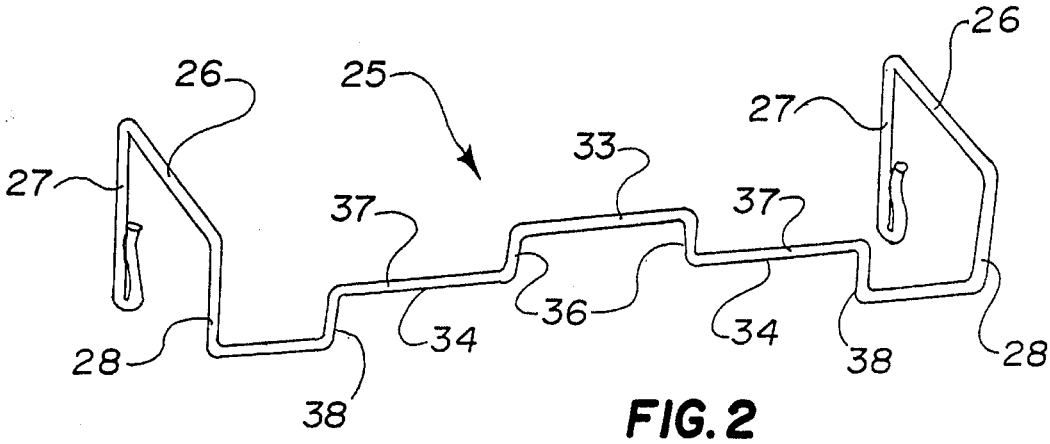
FIG. 2 is a perspective view of the bracket formed from wire.
Figure 3:
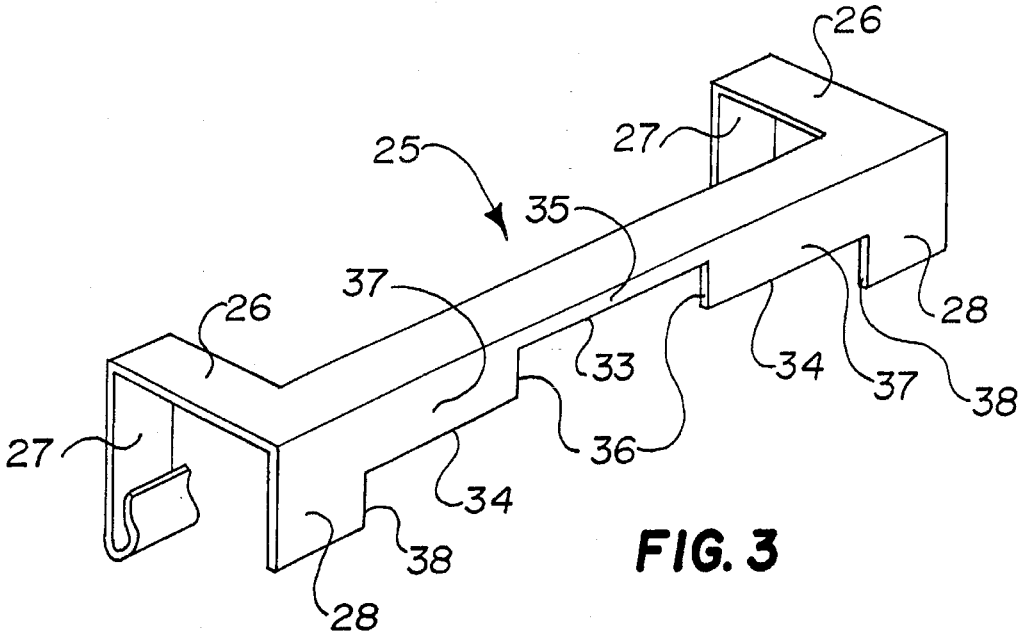
FIG. 3 is a perspective view of the bracket formed from a sheet of material.

A bracket 25 is removably connected to the upper end 17 of the back wall 13. The bracket 25 has a base 26 and a pair of legs 27, 28 connected approximately perpendicularly to the base 26 and along the length of the base 26 (FIGS. 2, 3). The first leg 27 is removably connected to the back wall 13 of the receptacle 11. The means of connection may be openings formed near the top end of the back wall in which the first leg 27 is engaged by means known to persons skilled in the art. Alternately, a hook, brace or other structure may be formed on the outside of the back wall 13 to which the first leg 27 may be removably attached. The opposite second leg 28 has a plurality of notches 33, 34 formed therein. Preferably, the notches are disposed in a steplike manner with a center notch 33 at approximately a midpoint of the length of the second leg 38. The center notch 33 is proximal to the base 26 of the bracket 25. A pair of intermediate notches 34 are disposed adjacent to the center notch 33, one intermediate notch 34 being on either side of the center notch 33. The intermediate notches are distal from the base 26 of the bracket 25 with respect to the center notch 33. In this manner, the intermediate notches 34 are viewed as forming a step on either side of the center notch 33 with the intermediate notches 34 defining a single notch wider than the center notch 33. The bracket 25 may be formed from wire bent in the shape as shown in FIG. 2 or may be formed from a sheet of rigid material as shown in FIG. 3. The rigid material may be plastic or metal.

Figure 4:
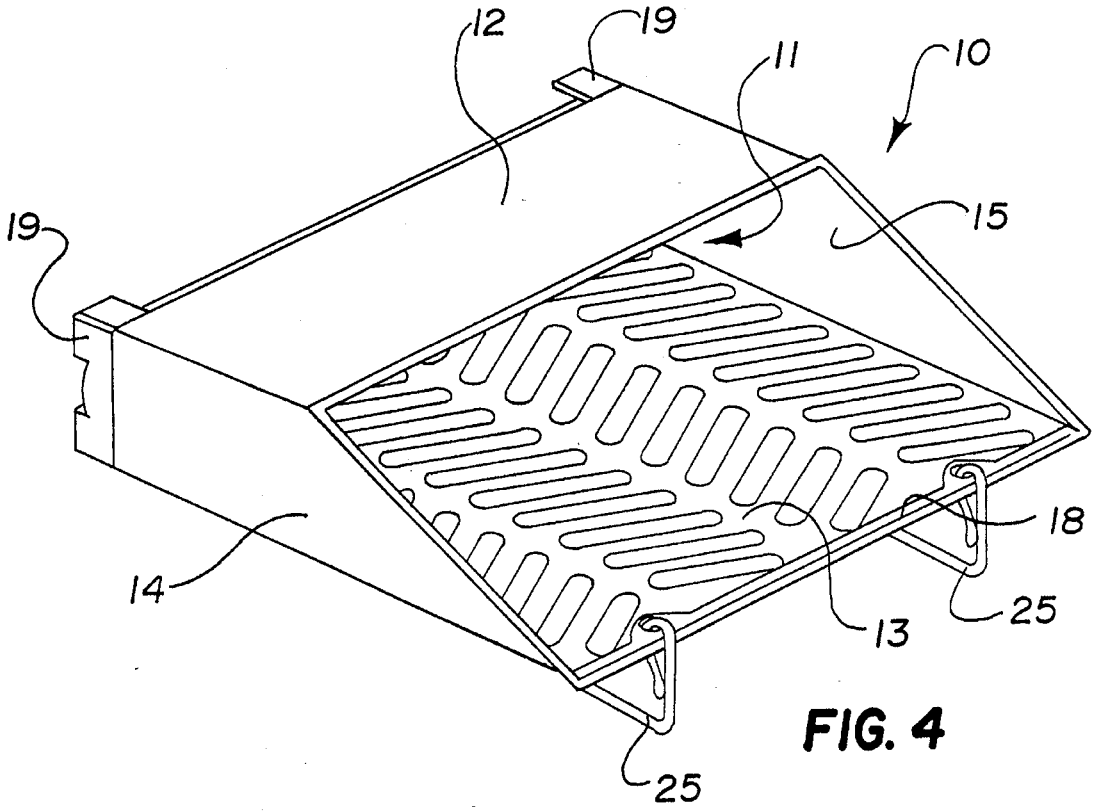
FIG. 4 is a perspective view showing the present invention supported on a horizontal surface.

The bracket 25, when connected to the back wall 13 of the paint pan 10, is pivoted thereto so that the first leg 27 may be in the same plane as the back wall 13 or may be approximately perpendicular thereto. When the bracket 25 is rotated to the position where the second leg 28 is perpendicularly disposed, the paint pan 10 may be placed on a horizontal surface and the bracket 25 elevates and supports the upper end 17 of the back wall 13. The receptacle 11 is oriented at an acute angle with respect to the horizontal surface (FIG. 4). In this manner, the paint pan 10 may be used as a conventional paint pan with a roller and a brush. Preferably, the receptacle 11 is large enough to contain one (1) gallon of paint even when the receptacle is disposed in the horizontal position.

The paint pan 10 of the present invention is versatile in that it can also be suspended from a ladder 40 either on the side, or on the face of the ladder 40, as will be described.

Figure 5:
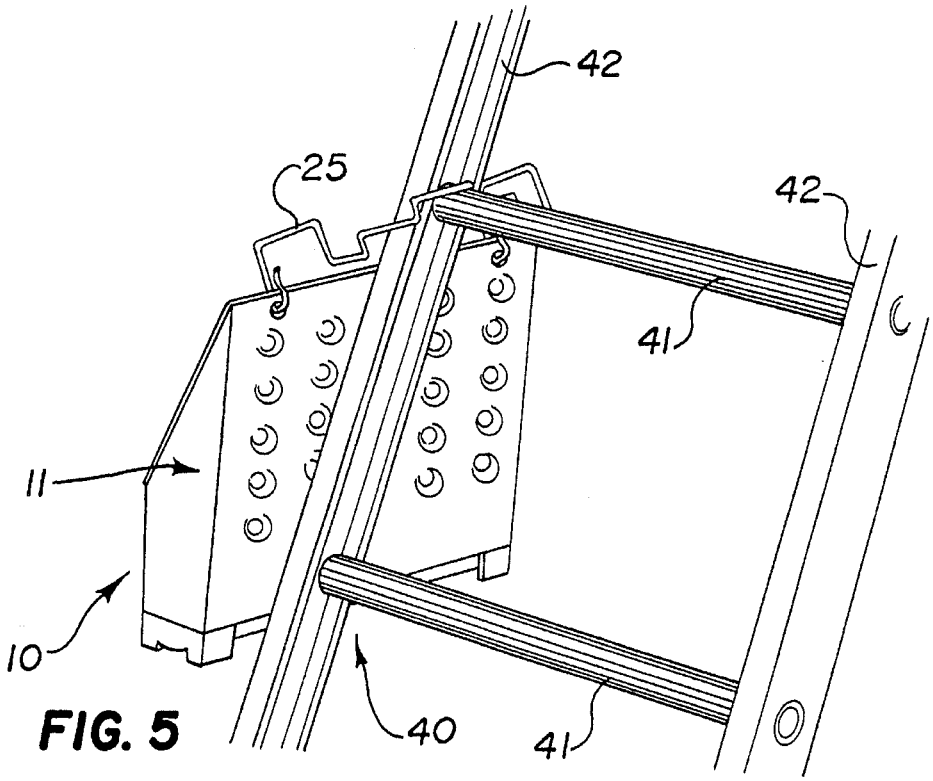
FIG. 5 is a perspective view showing the present invention suspended from a single step of a ladder with the receptacle outside the side rail of the ladder.
Figure 6:
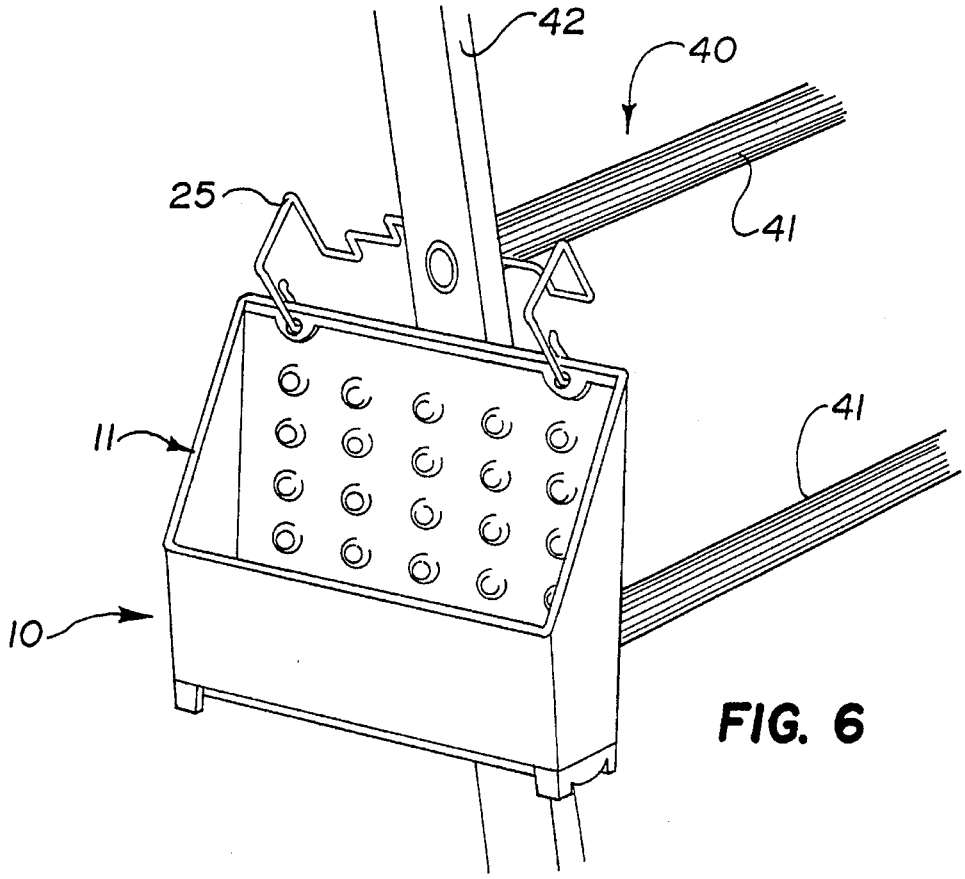
FIG. 6 is a perspective view of FIG. 5 taken from the opposite side of the paint pan.

The paint pan 10 is adapted to be supported on a selected step 41 (or rung) of the ladder 40 (FIGS. 5, 6). The first leg 27 of the bracket 25 is removed from the back wall 13 of the receptacle 11 and the receptacle 11 is disposed adjacent to the side rail 42 of the ladder 40, external to the ladder 40. The bracket 25 is disposed on the opposite side of the side rail 42 approximately perpendicularly to the selected step 41. In this manner, the step 41 is received in the center notch 33. The first leg 27 of the bracket 25 is reconnected to the back wall 13 of the receptacle 11 such that the first leg 27 of the bracket 25 is approximately in the substantially same plane as the back wall 13 and the receptacle 11 is suspended from the ladder 40 with the side rail 42 of the ladder 40 embraced between the receptacle 11 and the bracket 25. The paint pan 10 may be adapted to be supported at any selected step 41 along the entire length of the ladder 40 and adjacent to either side rail 42 of the ladder 40. Thus, as the painter ascends or descends the ladder 40, the paint pan 10 can be disposed conveniently to the right side or the left side of the painter. The suspended paint pan 10 can be used with a paint roller and/or a paint brush when so disposed.

Figure 7:
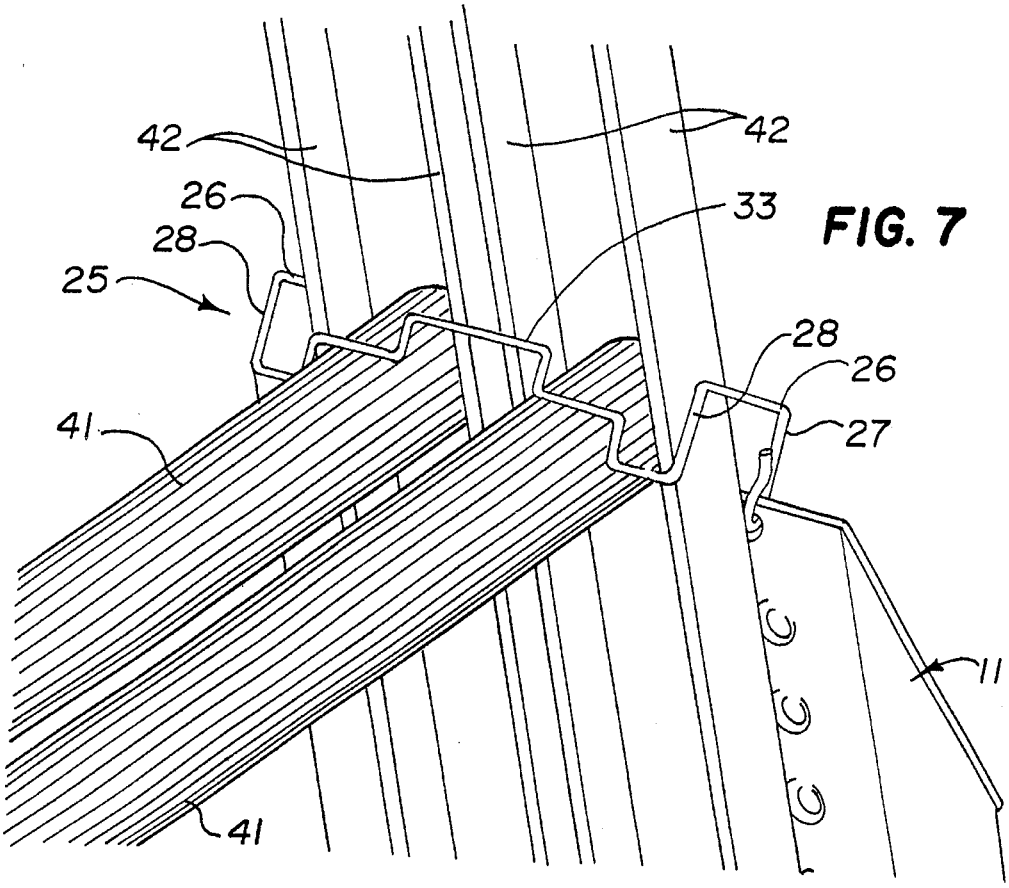
FIG. 7 is a perspective view showing the present invention suspended from two adjacent steps of the ladder with the receptacle outside the side rail of the ladder.
Figure 8:
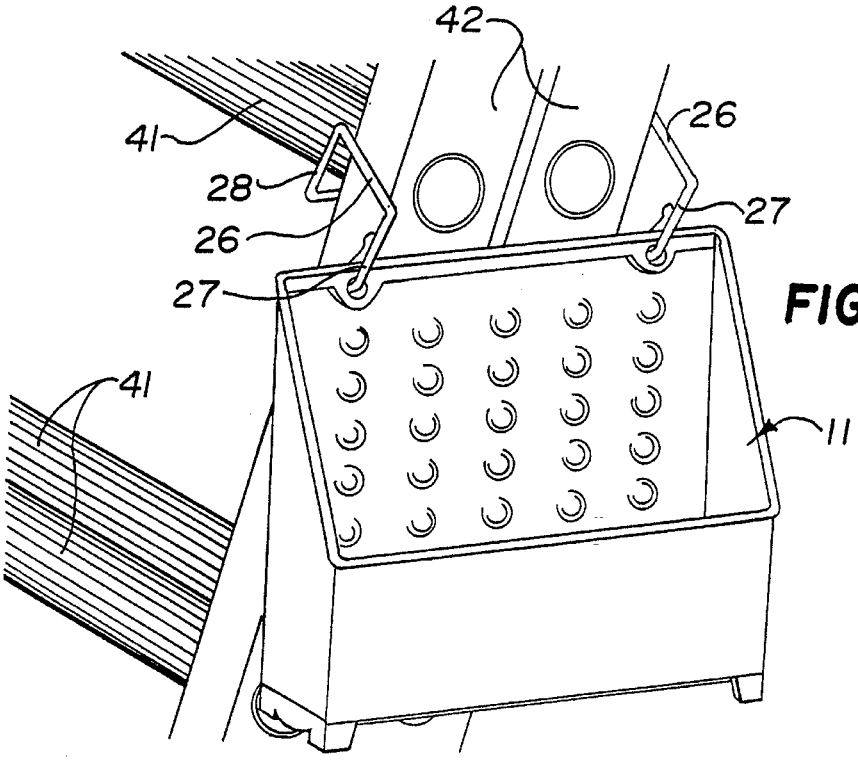
FIG. 8 is a perspective view of FIG. 7 taken from the opposite side of the paint pan.

In a similar manner, when the ladder 40 is a step ladder which is folded together or is an extension ladder which has not been extended and two steps 41 (or rungs) are side by side, approximately parallel in a horizontal plane, the two steps 41 are received in the intermediate notches 34 (FIGS. 7, 8). The combined widths of the two adjacent intermediate notches 34 and the center notch 33 is sufficient such that the two adjacent steps 41 fit snugly between the sides of the intermediate notches 34. The first leg 27 of the bracket 25 is removed from the back wall 13 and disposed on the inner side of the side rail 41 with the receptacle on the opposite side of the side rail 41 just as described for suspension from the single step 41. When the bracket 25 is reconnected to the back wall 13, the receptacle 11 is disposed external to the ladder 40 with the bracket 25 inside the side rail 42 approximately perpendicular to the pair of side-by-side steps 41.

The center notch 33 has a top portion 35 and two sides 36 depending from the top portion 35. Preferably the sides 36 are disposed at an acute angle with respect to the top portion 35 such that the width of the center notch 33 is greatest near the top portion 35. In this manner, when the bracket 25 is disposed over the one step 41, the sides 36 serve as a clip to retain the step 41 within the center notch 33. The intermediate notches 34 each have a top portion 37 which join the respective sides 36 of the center notch 33. Each intermediate notch 34 has a side 38 which is distal from the center notch 33. Preferably, the respective sides 38 of each intermediate notch 34 is oriented at an acute angle with respect to the top of the corresponding intermediate notch 34. The width of the intermediate notches 34 is greatest at the top portion 37 of the intermediate notches 34. In this manner, when the bracket 25 is disposed over two side-by-side steps 41, the sides 38 of the intermediate notches 34 serve as a clip to secure the bracket 25 to the steps 41. Just as when suspended from a single step, lateral movement of the paint pan 10 with respect to the ladder 40, is limited and the paint pan 10 may be moved to any desired pair of steps 41. Also, the paint pan 10 may be used with a paint roller and/or a paint brush.

Figure 9:
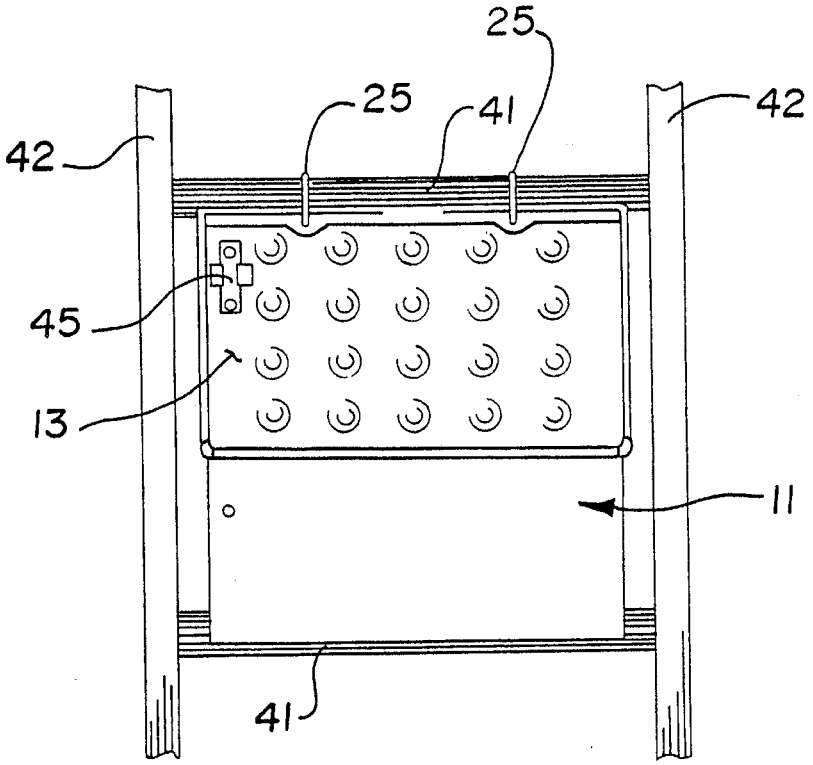
FIG. 9 is a front elevation view showing the present invention suspended from a step of the ladder between the side rails.
Figure 10:
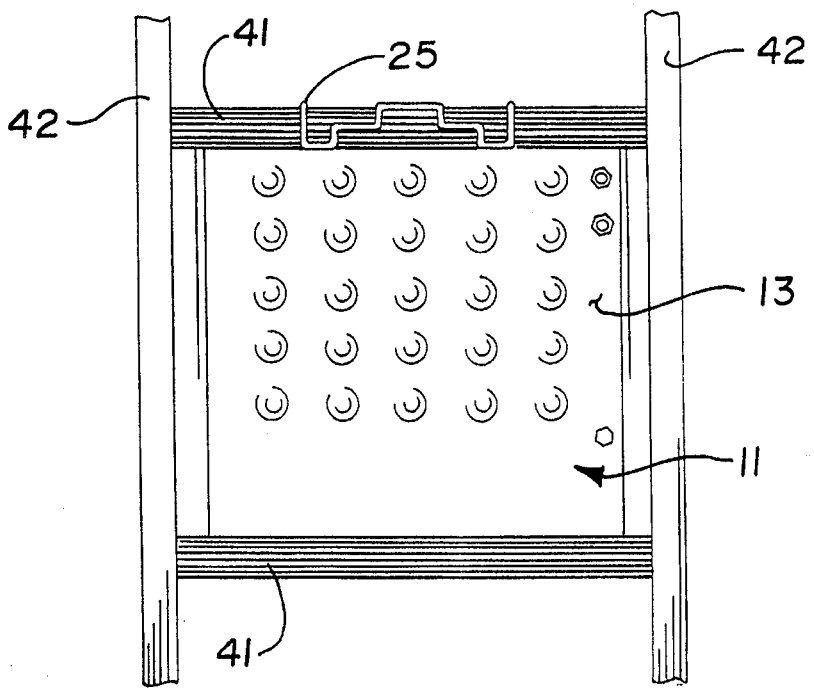
FIG. 10 is a rear elevation view of FIG. 9 taken from the opposite side of the paint pan.
Figure 11:
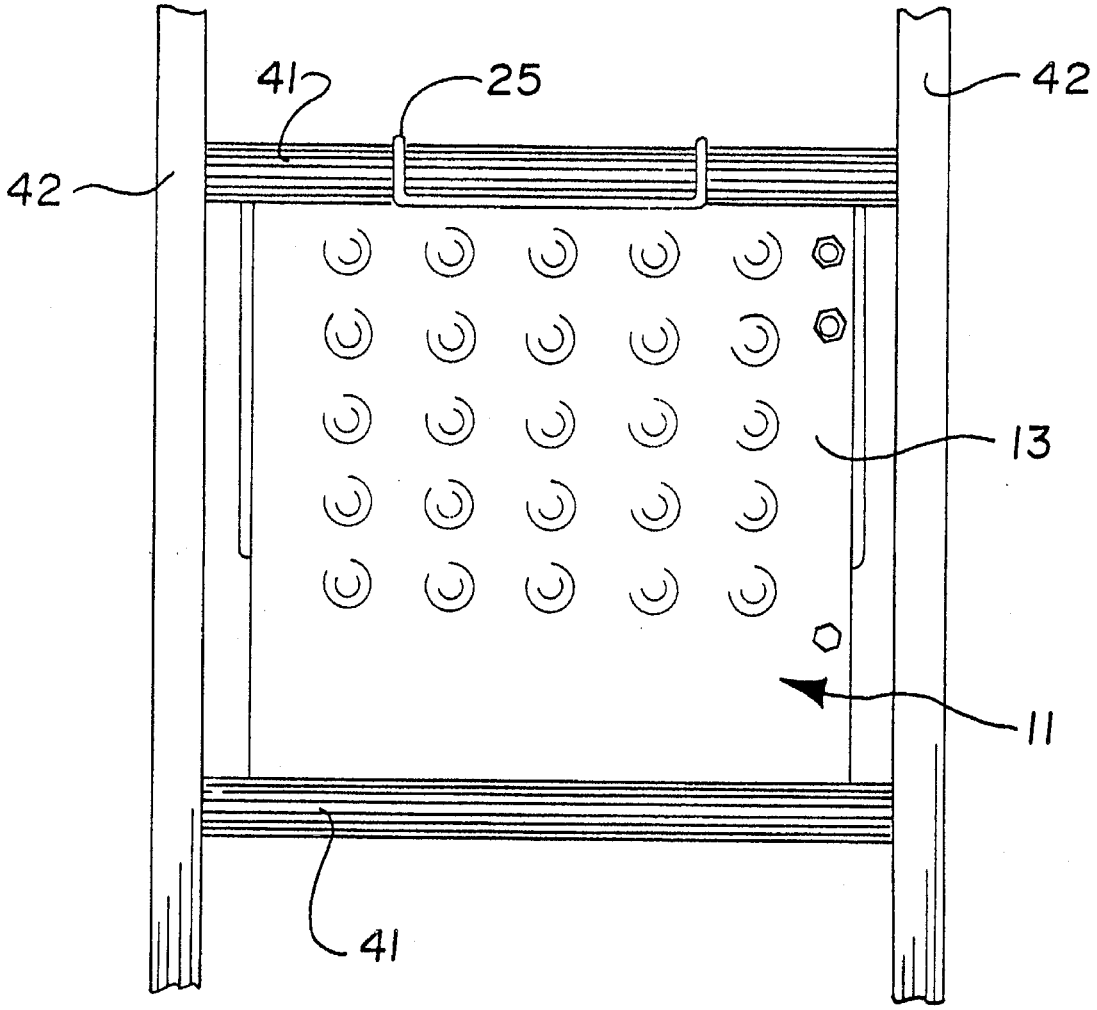
FIG. 11 is a rear elevation view showing the present invention suspended from a step of the ladder between the side rails by another embodiment of the bracket.

Alternately, as shown in FIGS. 9 and 10, the paint pan 10 may be adapted to be suspended from a selected step 41 of the ladder 40 and substantially parallel to the selected step 41 between the side rails 42 of the ladder 40. In this adaptation, the bracket 25 is pivoted above the receptacle 11 such that the first leg 27 of the bracket is disposed on an edge of the step 41 and the second leg 28 of the bracket is disposed on the opposite edge of the step 41 and the base 26 of the bracket is supported along the length of the step 41 between the edges of the step 41. The width of the base 26 between the legs 27, 28 is slightly greater than the depth of the step 41 such that the step 41 is received between the legs 27, 28 and the bracket 25 straddles the step 41. The bracket 25 may also be formed without any steps to be used to suspend the receptacle 11 parallel to a selected step between the side rails of the ladder (FIG. 11). The receptacle 11 is suspended vertically from the step 41 and is disposed on the face of the ladder 40. The paint pan 10 may be connected to any desired step between the top and the bottom of the ladder 40 to be convenient as the painter ascends or descends the ladder 40. The paint pan 10 is useable with a paint roller and/or a paint brush when so suspended.

Figure 12:
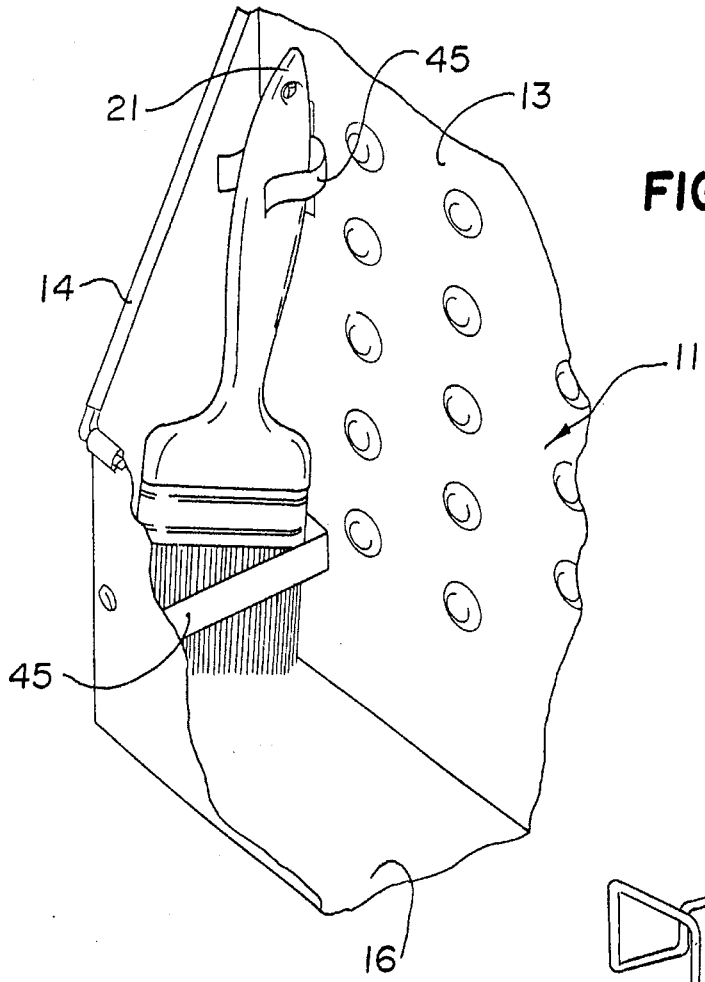
FIG. 12 is a perspective view of a brush retained in the brush holder of the present invention.
Figure 13:
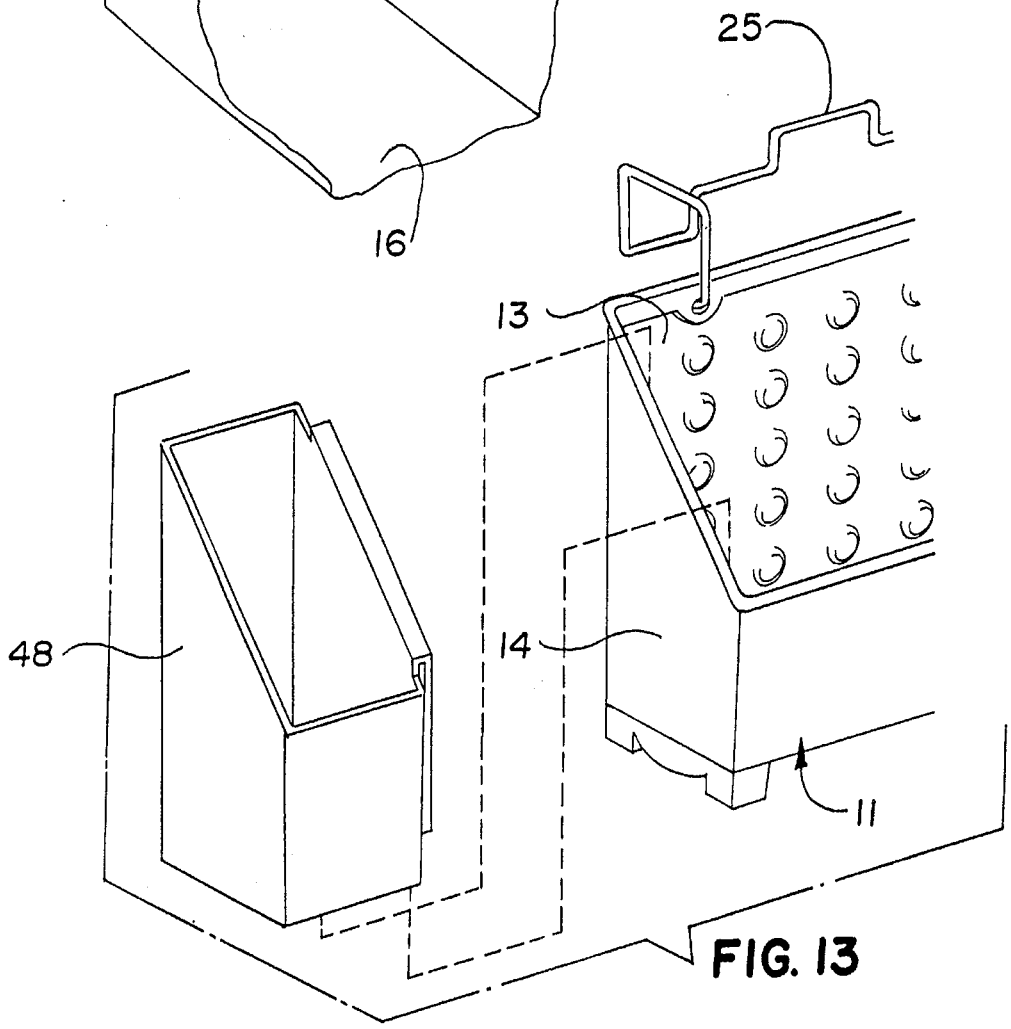
FIG. 13 is a perspective view showing a compartment for tools on the side of the receptacle of the present invention.

The paint pan 10 of the present invention may further have a holding means 45 for a paint brush disposed within the receptacle 11. The holding means 45 may be a compartment in which the paint brush may be supported or it may be a clip or clamp to retain the handle of the paint brush. The holding means 45 preferably is disposed within the receptacle 11 (FIG. 12). Alternately, a compartment 48 may be attached to the side of the receptacle to contain a paint brush or tools (FIG. 13).

Figure 14:
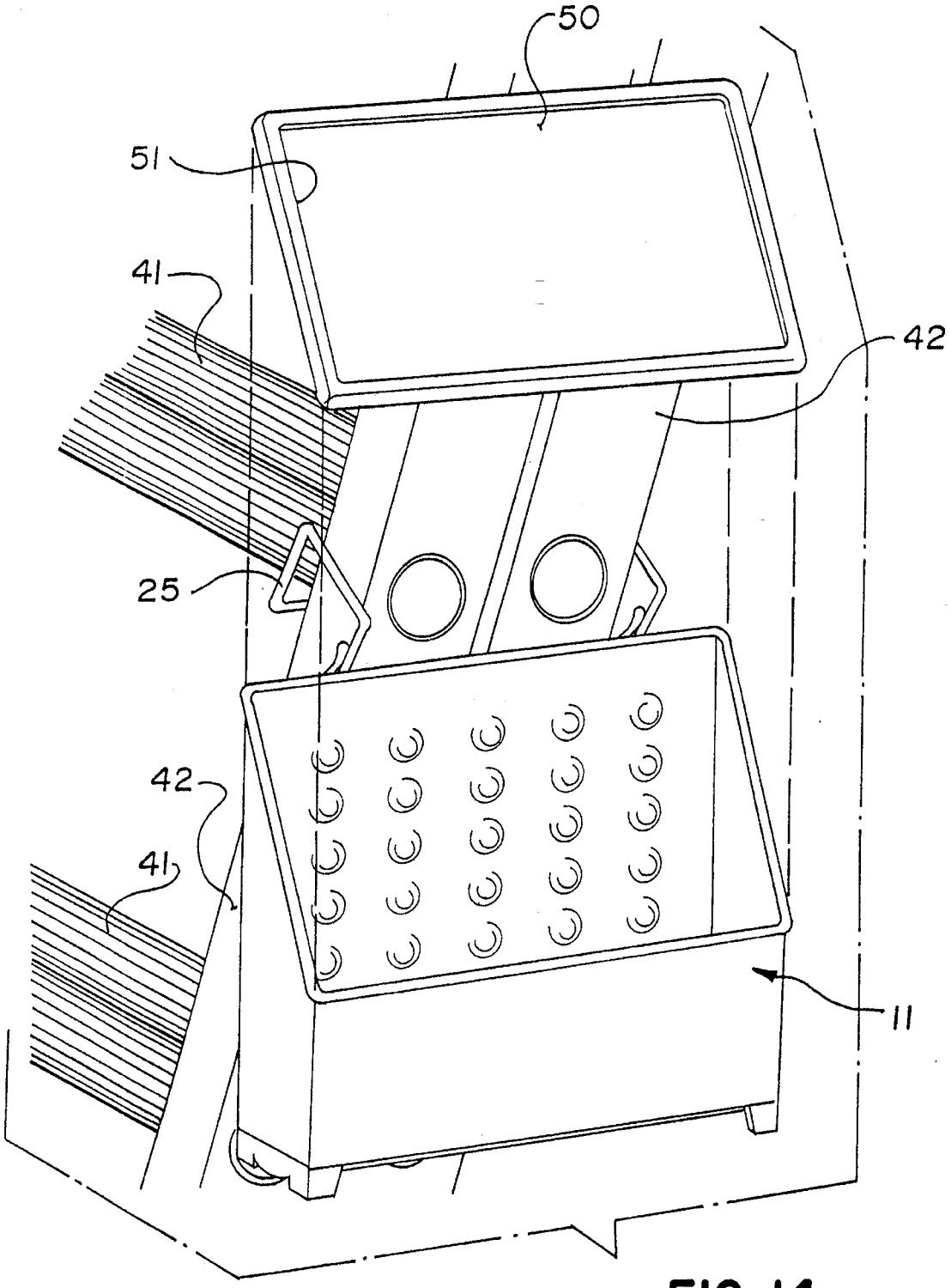
FIG. 14 is an exploded view showing a cover on the top of the receptacle of the present invention.

The paint pan 10 of the present invention may further be provided with a cover 50 for the top of the receptacle 11 so that paint may be stored within the receptacle 11 without drying (FIG. 14). Means 51 for attaching the cover 50 to the receptacle 11 may be by a buckle, a latch and hoop, by spring connectors or by a self-gripping seal. The closure should be sealed around the periphery of the receptacle 11. The cover 50 may be hingably connected to the receptacle 11.

The versatile paint pan 10 of the present invention may be formed of metal or plastic and can be produced for a comparatively low cost to permit mass marketing of the paint pan 10.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A paint pan for use on a horizontal surface and for suspension alternately from a side and from a face of a ladder, the ladder having a pair of side rails and a plurality of steps between the side rails, the paint pan including a receptacle having a front wall, a back wall, a first side wall, an opposite second side wall, a bottom and an open top, the back wall being longer than the front wall, the back wall having an upper end, the improvement comprising:

a one piece bracket removably connected to the upper end of the back wall, wherein the paint pan may be disposed on the horizontal surface, the bracket having means thereon for supporting and elevating the upper end of the back wall of the receptacle and the receptacle being oriented at an acute angle with respect to the horizontal surface such that a paint roller and a paint brush may be used, the bracket having means thereon for support of the paint pan on a selected one of the steps of the ladder, transversely thereof, wherein the bracket is secured on the selected one of the steps of the ladder and the receptacle is suspended vertically adjacent to one of the side rails of the ladder, external of the ladder, the side rail of the ladder being embraced by the bracket and the receptacle such that the paint roller and the paint brush may be used, the bracket having means thereon for support of the paint pan on the selected one of the steps of the ladder substantially parallel thereto, wherein the bracket is secured on the selected one of the steps of the ladder and the receptacle is suspended vertically therefrom between the side rails along the face of the ladder, such that the paint roller and the paint brush may be used.

2. The paint pan of claim 1, wherein the means on the bracket are a pair of opposing legs, the legs being connected by a base, the first leg being removably connected to the upper end of the back wall of the receptacle, the second leg having a plurality of step-like notches formed therein, the notches forming a clip to receive the selected one of the steps.

3. A paint pan for use on a horizontal surface for suspension alternately from a side and from a face of a ladder, the ladder having a pair of side rails and a plurality of steps between the side rails, the paint pan including a receptacle having a front wall, a back wall, a first side wall, an opposite second side wall, a bottom and an open top, the back wall being longer than the front wall, the back wall having an upper end, the improvement comprising:

a bracket removably connected to the upper end of the back wall, wherein the paint pan may be disposed on the horizontal surface, the bracket supporting and elevating the upper end of the back wall of the receptacle and the receptacle being oriented at an acute angle with respect to the horizontal surface such that a paint roller and a paint brush may be used, the bracket further being adapted for support on a selected one of the steps of the ladder, transversely thereof, wherein the bracket is secured on the selected one of the steps of the ladder and the receptacle is suspended vertically adjacent to one of the side rails of the ladder, external of the ladder, the side rail of the ladder being embraced by the bracket and the receptacle such that the paint roller and the paint brush may be used, the bracket further being adapted for support on the selected one of the steps of the ladder substantially parallel thereto, wherein the bracket is secured on the selected one of the steps of the ladder and the receptacle is suspended vertically therefrom between the side rails along the face of the ladder, such that the paint roller and the paint brush may be used, wherein the bracket has a base, a first leg and an opposing second leg, the legs being substantially perpendicular to the base, the first leg being removably connected to the upper end of the back wall of the receptacle, the second leg having a plurality of notches formed therein, the notches being step-like having a center notch proximal to the base of the bracket and a pair of intermediate notches stepwise adjacent to, and on the respective opposite sides of, the center notch, the intermediate notches being distal from the base of the bracket in relation to the center notch, the notches forming a clip to receive the the selected one of the steps of the ladder.

4. The improvement of claim 3, further comprising the center notch having a width and the selected one of the steps of the ladder having a width, the width of the center notch being slightly greater than the width of the selected one of the steps of the ladder, wherein the selected one of the steps of the ladder is received in the center notch and the bracket is secured to the selected one of the steps of the ladder such that the receptacle, attached to the first leg of the bracket by the upper end of the back wall is suspended vertically adjacent to the one side rail of the ladder approximately perpendicularly to the selected one of the steps of the ladder.

5. The improvement of claim 3, further comprising the center notch and the two intermediate notches each having a respective width, the ladder being disposed such that two selected steps of the ladder are adjacent and parallel to one another, the selected steps each having a respective width, the combined widths of the center notch and the two intermediate notches being slightly greater than the combined widths of the two adjacent selected steps, wherein the selected steps of the ladder are received between the intermediate notches and the bracket is secured to the selected steps of the ladder, such that the receptacle, attached to the first leg of the bracket by the upper end of the back wall, is suspended vertically adjacent to the side wall of the ladder approximately perpendicularly to the selected steps of the ladder.

6. The improvement of claim 3, further comprising the selected one of the steps of the ladder having a depth, the base of the bracket having a width, the width of the base of the bracket being slightly greater than the depth of the selected one of the steps, wherein the bracket is disposed straddling the selected one of the steps, the base of the bracket being supported by the selected one of the steps, the receptacle being suspended vertically from the selected one of the steps on the face of the ladder between the side rails of the ladder and approximately parallel to the selected one of the steps.

7. The improvement of claim 3, further comprising the center notch and the intermediate notches each having a respective top portion and respective sides, the sides being disposed at an acute angle with respect to the top portions of the respective notches such that the respective notches each have a width greatest at the respective top portions wherein the bracket is secured to the selected one of the steps of the ladder between the respective sides of the notches.

8. The improvement of claim 3, wherein the bracket is formed from wire.

9. The improvement of claim 3, wherein the bracket is formed from a sheet of rigid material.

10. The improvement of claim 3, further comprising a cover removably connected to the open top of the receptacle wherein paint may be stored in the receptacle.

11. The improvement of claim 3, further comprising holding means disposed within the receptacle wherein the paint brush may be held within the receptacle.

12. The improvement of claim 3, further comprising support means formed on the bottom of the receptacle wherein the paint pan is self supporting in an upright position when placed on the horizontal surface.

13. The improvement of claim 3, wherein the bottom of the receptacle is arcuate such that paint may be removed from the receptacle with the paint roller and the paint brush.

14. The improvement of claim 3, further comprising the upper end of the back wall of the receptacle having a lip formed thereon, the lip being oriented toward the front wall, the lip preventing paint from spilling from the receptacle when the paint pan is disposed on the horizontal surface.

15. The improvement of claim 3, further comprising a plurality of spaced apart raised members being formed on the back wall, wherein the paint roller may be rolled over the raised members to remove excess paint.

16. The improvement of claim 3, further comprising a compartment attached to one of the side walls of the receptacle, the compartment to hold tools.

17. A paint pan for use on a horizontal surface and for suspension alternately from a side and from a face of a ladder, the ladder having a pair of side rails and a plurality of steps between the side rails, the paint pan including a receptacle having a front wall, a back wall, a first side wall, an opposite second side wall, a bottom and an open top, the back wall being longer than the front wall, the back wall having an upper end, the improvement comprising:

a bracket removably connected to the upper end of the back wall, the bracket having a base, a first leg and an opposite second leg, the legs being substantially perpendicular to the base, the first leg being removably connected to the upper end of the back wall of the receptacle, the second leg having a plurality of notches formed therein, the notches being step-like having a center notch proximal to the base of the bracket and a pair of intermediate notches stepwise adjacent to, and on the respective opposite sides of, the center notch, the intermediate notches being distal from the base of the bracket in relation to the center notch, wherein the paint pan may be disposed on the horizontal surface, the bracket supporting and elevating the upper end of the back wall of the receptacle and the receptacle being oriented at an acute angle with respect to the horizontal surface such that a paint roller and a paint brush may be used, the bracket further being adapted for support on a selected one of the steps of the ladder, transversely thereof, wherein the bracket is secured on the selected one of the steps of the ladder and the receptacle is suspended vertically adjacent to one of the side rails of the ladder, external of the ladder, the side rail of the ladder being embraced by the bracket and the receptacle, such that the paint roller and the paint brush may be used, the bracket further being adapted for support on the selected one of the steps of the ladder substantially parallel thereto, wherein the bracket is secured on the selected one of the steps of the ladder and the receptacle is suspended vertically therefrom between the side rails along the face of the ladder, such that the paint roller and the paint brush may be used.

* * * * *